United States Patent [19]

Lala et al.

[11] Patent Number: 4,535,549

[45] Date of Patent: Aug. 20, 1985

[54] CURING APPARATUS

[75] Inventors: Louis A. Lala, Skokie; James H. Frenchy, Chicago, both of Ill.

[73] Assignee: American Screen Printing Equipment Company, Chicago, Ill.

[21] Appl. No.: 548,207

[22] Filed: Nov. 2, 1983

[51] Int. Cl.[3] ..... F26B 3/30

[52] U.S. Cl. ..... 34/4; 34/39; 34/105

[58] Field of Search ..... 250/453.1, 454.1, 503; 34/4, 39, 68, 1, 105

[56] References Cited

U.S. PATENT DOCUMENTS

| | | | |
|---|---|---|---|
| 3,506,825 | 4/1970 | Hartmann | 250/454.1 |
| 3,840,999 | 10/1974 | Whelan | 34/105 |
| 3,894,237 | 7/1975 | Choate et al. | 250/453.1 |
| 4,193,204 | 3/1980 | Nerod | 34/105 |
| 4,297,583 | 10/1981 | Nerod | 34/4 |

*Primary Examiner*—Larry I. Schwartz

*Attorney, Agent, or Firm*—Fitch, Even, Tabin & Flannery

[57] ABSTRACT

An apparatus for curing ink screen print on articles, particularly large articles such as pails or barrels, includes a rotatable turntable having a plurality of spin table compartments each of which is to receive a pail and carry the same in a circular path past a radiation source covered by a housing at a curing station. Each article is spun as it reaches the curing station to assure complete irradiation about the circumference of each article. The housing is provided with a large opening to facilitate loading of articles onto the spin tables and removal of articles with cured ink from the spin tables while the turntable continuously rotates.

15 Claims, 8 Drawing Figures

FIG. 1
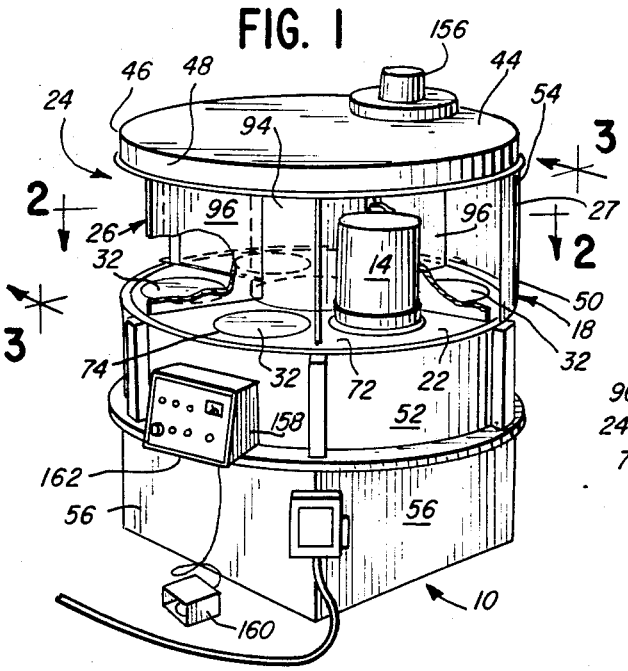
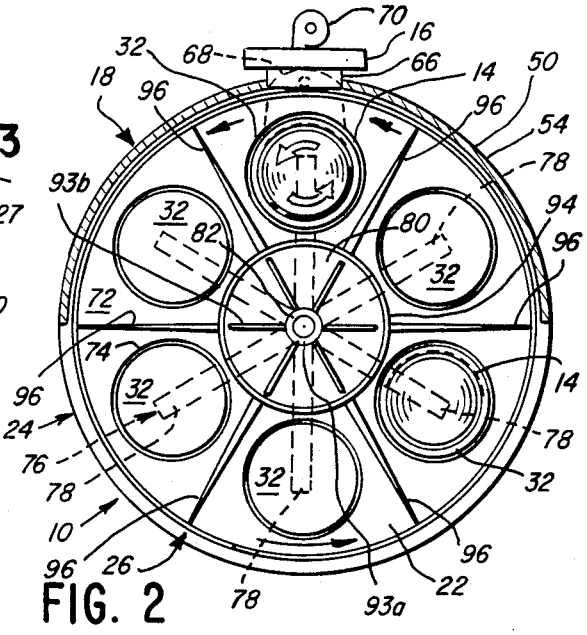
FIG. 2
FIG. 3
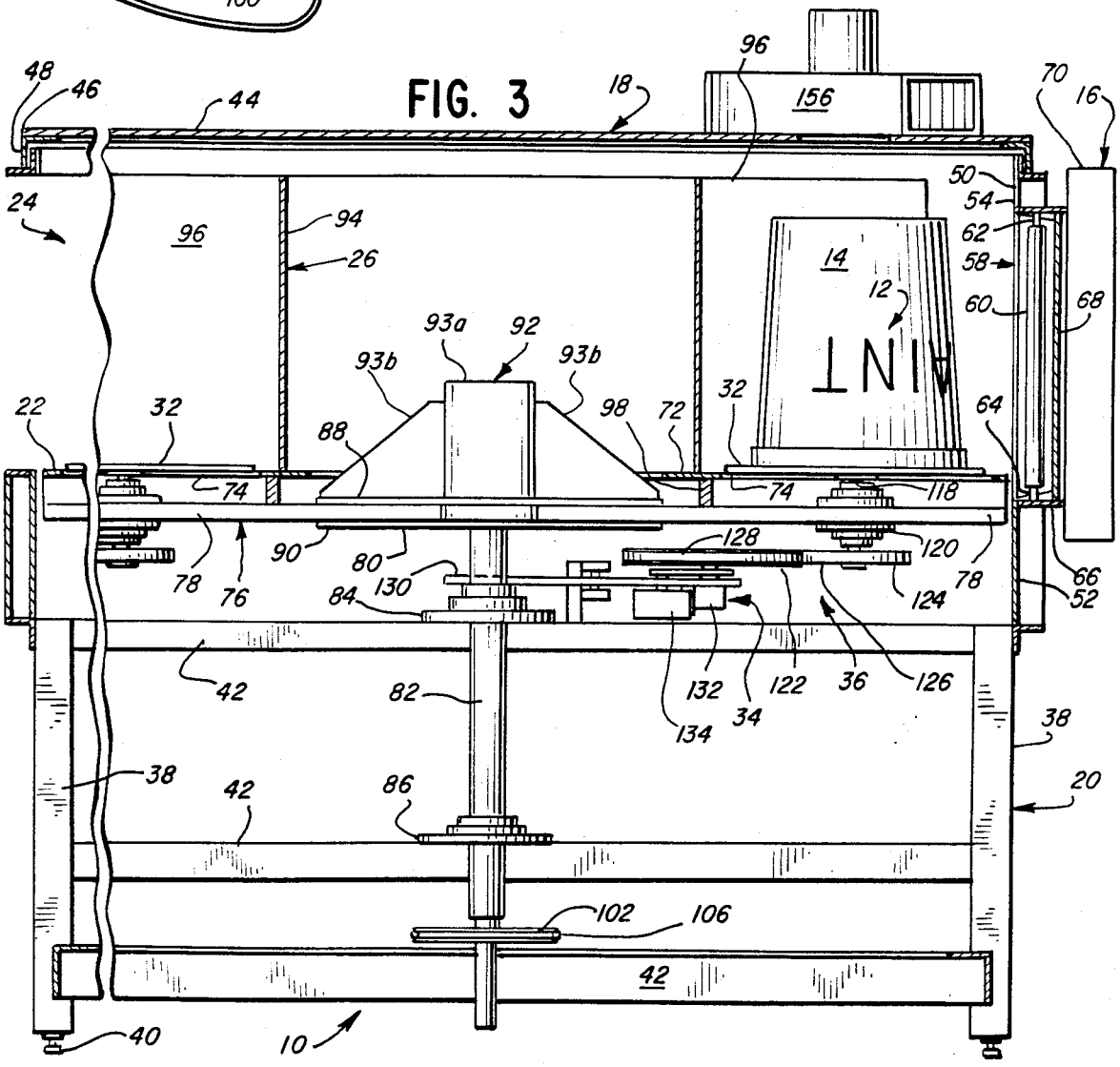

FIG. 4
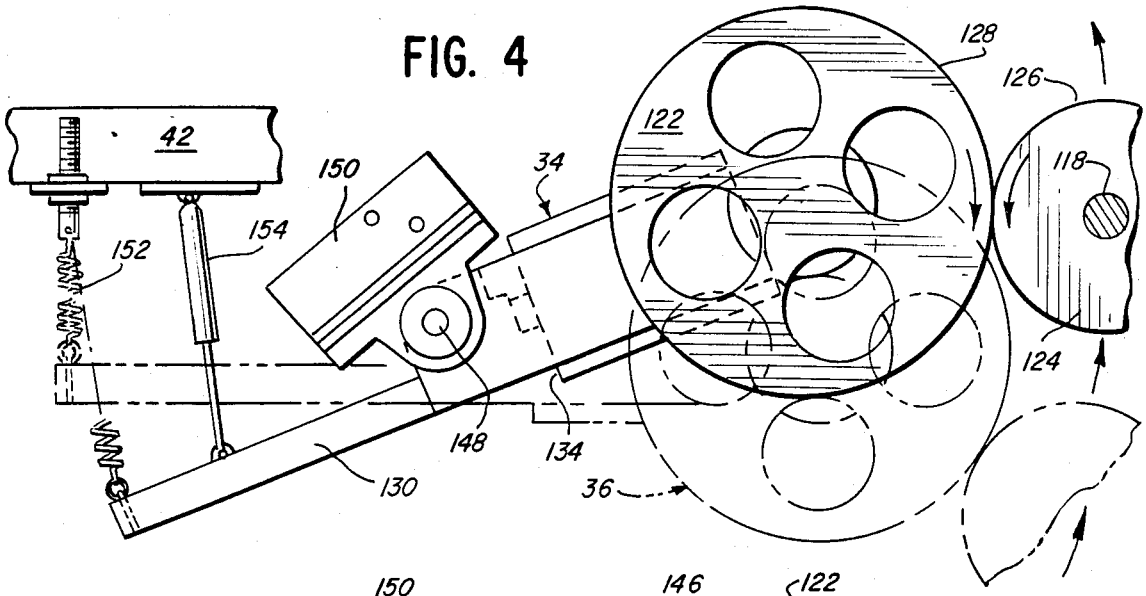
FIG. 5
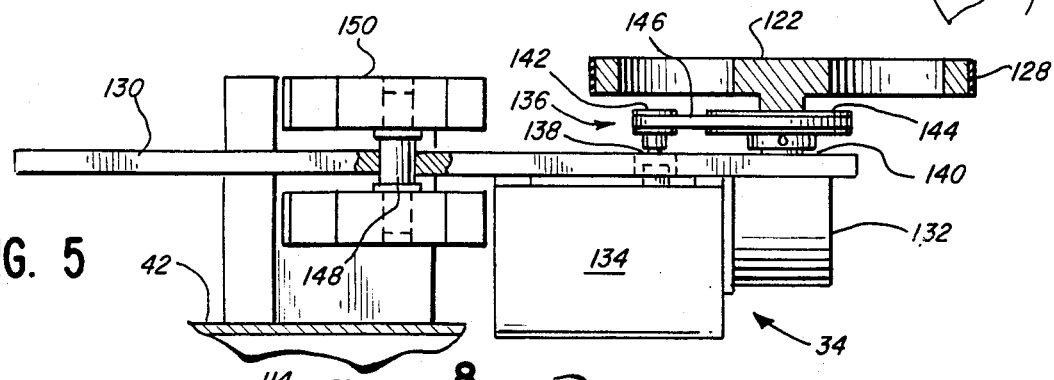
FIG. 6
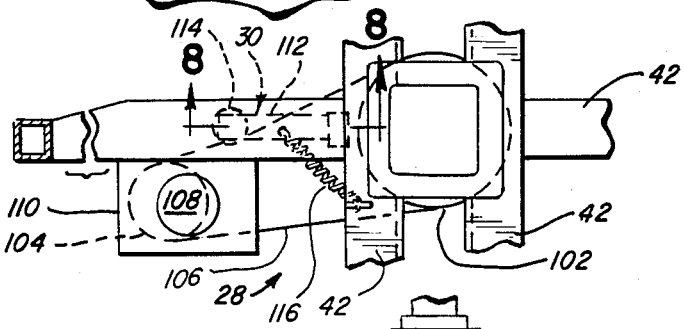
FIG. 7
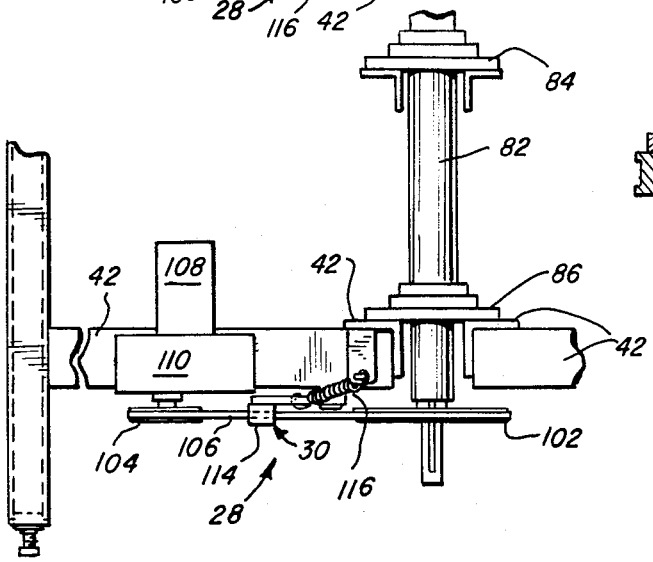
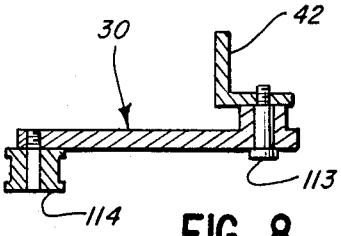
FIG. 8

CURING APPARATUS

BACKGROUND OF THE INVENTION

The present invention relates generally to ink curing apparatus and methods, and relates more particularly to a method and apparatus for transporting articles past one or more sources of radiation within an enclosure.

Various articles have labels or designs printed upon their exterior surfaces with ink which may be cured by exposure to infrared or ultraviolet radiation. Typical of such articles are plastic containers or bottles having necks, and larger containers such as buckets. Because the printed matter on such articles frequently extends around the entire circumference of the article or is located at various locations about the circumference of the article, it is desirable that curing apparatus provide 360° exposure to ultraviolet radiation for each article. In the past, some types of curing apparatus have included means for gripping container necks to support them and rotate them while transporting them past an ultraviolet lamp. While such apparatus may be satisfactory for use with necked containers, it may not be suitable for curing ink on large articles such as buckets which do not have necks.

Large articles such as five gallon paint buckets or even larger barrels are difficult to handle on automated or semi-automated equipment. Most existing equipment is not, or cannot be, adapted to cure such articles in an economical manner. There is a need for an inexpensive and efficient apparatus to cure ink on such large articles.

Exposure of persons to excessive amounts of ultraviolet radiation is undesirable. Accordingly, ultraviolet curing apparatus may include an ultraviolet lamp enclosed within a housing for confining the radiation, and means to transport articles past the lamp within the housing so to expose the articles to the ultraviolet radiation without exposing any workers to the radiation.

In commercial printing operations, ultraviolet curing apparatus is commonly used in proximity to the printing equipment which deposits the ink on the articles so that the ink may be cured immediately after it is applied. It is desirable that the curing apparatus be capable of being loaded and unloaded with the printed articles in a safe and expeditious manner and that the apparatus be capable of curing articles at a rate equal to the output rate of the printing apparatus. The exposure time required to cure the ink on a particular article may be relatively short, and accordingly the time required for loading an article and transporting the article from an input location to the curing station and then to an output location for unloading the article with cured ink thereon may be significant. There is a continuing demand for ultraviolet curing methods providing improvements in the handling of articles to increase the efficiency of curing operations.

SUMMARY OF THE INVENTION

In accordance with the present invention, curing apparatus is provided which includes means to irradiate articles at a curing station within a housing, and which employs a turntable to transport articles from an opening in the housing through the curing station. Preferably, a single opening in the housing allows a single worker at a single location to load articles onto the turntable for curing and remove them from the turntable after curing. To prevent emission of light from the ultraviolet lamp to the exterior of the housing through the opening, an upstanding divider is mounted on the turntable. The divider defines a plurality of compartments on the turntable for containing the articles, and the articles are spun within their respective compartments while being irradiated.

Rotation of the turntable may be stopped automatically if the hand of the operator or one of the articles should become caught between the divider and the housing. To this end, the preferred turntable drive includes torque-limiting means to prevent torque on the turntable from exceeding a desired maximum. To enable the various articles to be rotated for 360° exposure as they are carried past the ultraviolet lamp, a plurality of spin tables are rotatably mounted on the turntable and spin table drive means are provided for rotating the spin tables relative to the turntable. In the illustrated embodiment, the spin tables are not connected to the spin table drive means when they are in position adjacent the opening in the housing, so that articles may be loaded onto or unloaded from the turntable without the spin tables rotating. Clutch means are provided to selectively associate the spin table drive means with each of the spin tables as it approaches the ultraviolet lamp.

Accordingly, a general object of the invention is to provide a new and improved apparatus for irradiating ink on articles.

BRIEF DESCRIPTION OF THE DRAWINGS

FIG. 1 is a perspective view of curing apparatus in accordance with the present invention, shown with portions broken away for clarity.

FIG. 2 is a sectional view of the apparatus of FIG. 1, taken along line 2—2 and looking in the direction of the arrows.

FIG. 3 is an enlarged sectional view of the apparatus of FIG. 1, taken along line 3—3 in FIG. 1 and looking in the direction of the arrows.

FIG. 4 is an enlarged fragmentary plan view of the spin table drive of the curing apparatus of FIG. 1.

FIG. 5 is a side elevational view of the spin table drive illustrated in FIG. 4, shown with portions broken away for clarity and with portions taken in section.

FIG. 6 is an enlarged plan view of the turntable drive of the curing apparatus in FIG. 1.

FIG. 7 is a side elevational view of the turntable drive of FIG. 6.

FIG. 8 is a sectional view, taken substantially along line 8—8 in FIG. 6 and looking in the direction of the arrows.

DETAILED DESCRIPTION OF A PREFERRED EMBODIMENT

The present invention is generally embodied in a method and apparatus, indicated generally at 10, for curing ink 12 (FIG. 3) on exterior surfaces of articles 14 by irradiating the exterior surfaces of the articles 14. The apparatus 10 includes irradiating means for irradiating ink on the articles. Although the irradiating means could provide infrared or other radiation, the preferred irradiating means comprises an ultraviolet lamp 16 for providing ultraviolet light at a curing station within a housing 18. The housing 18 is supported by a frame 20.

In accordance with the present invention, the articles 14 are transported past the ultraviolet lamp 16 by a turntable 22 which is mounted for rotation within the housing 18 and which supports the articles 14 from below. Preferably, a single worker at a single location loads articles 14 onto the turntable 22 for curing and removes them from the turntable 22 after curing. To this end, the housing 18 has a single opening 24 in it for insertion and withdrawal of articles 14. To prevent emission of light from the ultraviolet lamp 16 to the exterior of the housing 18 through the opening 24, an upstanding divider means 26 is mounted on the turntable 22 and divides the turntable into a plurality of sector-shaped article-receiving compartments, each of which receives an article 14 and carries the article in a counterclockwise direction into and past the curing station. Herein, six compartments are provided on the turntable. Three compartments are available at the opening for loading and unloading.

Turntable drive means, indicated generally at 28, rotate the turntable 22 at the desired speed. To enable the rotation of the turntable 22 to be stopped automatically if the hand of the operator or one of the articles 14 should become caught between the divider 26 and the housing 18, the preferred turntable drive means 28 include torque-limiting means 30 to prevent torque on the turntable 22 from exceeding a desired maximum. Additionally, a limit switch may be provided in a flexible vertical panel 27 (FIG. 1) adjacent the opening 24 in the housing to be activated if the operator's hand engages the panel 27. Actuation of the switch will limit the drive torque applied to the turntable.

At the curing station, each article 14 rotated by a spin table 32 for 360° exposure as it is carried past the ultraviolet lamp 16. One spin table 32 is rotatably mounted on the turntable 22 in each compartment. Spin table drive means 34 are provided for rotating the spin tables 32 relative to the turntable 22. In the illustrated embodiment, the spin tables 32 are not connected to the spin table drive means 34 when they are in position adjacent the opening 24 in the housing 18, so that articles 14 may be loaded onto or unloaded from the turntable 22 without the spin tables 32 rotating. A clutch assembly 36 (FIGS. 3 and 4) is provided to selectively associate the spin table drive means 34 with each of the spin tables 32 as the particular spin table 32 approaches the ultraviolet lamp 16.

The illustrated apparatus 10 is sized to handle articles 14 such as buckets on the order of twelve inches or more in height. In another embodiment of the invention not illustrated herein, the apparatus is sized to accommodate much larger articles, such as 55 gallon drums.

Turning now to a more detailed description of the illustrated embodiment of the present invention, the frame 20 includes a plurality of upstanding legs 38 having adjustable feet 40 at their lower ends for leveling the apparatus 10. A plurality of horizontal support members 42 extend between the legs 38 for supporting various components of the apparatus 10, as described in greater detail below.

The housing 18 is supported by the frame 20 and includes a top wall 44 having a generally circular periphery 46 with a depending skirt 48. The top wall 44 is supported by a curved side wall 50 which has a lower portion 52 which extends about the circumference of the turntable 22 below the turntable, and an upper portion 54 which extends partially around the circumference of the turntable 22 above the turntable, thus defining the opening 24 which provides access to the turntable 22. In the illustrated embodiment, the opening 24 extends approximately halfway around the circumference of the side wall 50. The relatively long circumferential dimension facilitates insertion and removal of articles through the opening 24 by providing access to each spin table 32 during approximately half of its travel. A plurality of side panels 56 (FIG. 1) enclose the frame 20 beneath the turntable 22.

To provide ultraviolet radiation within the housing 18, the ultraviolet lamp 16 is mounted on the curved side wall 50 adjacent an opening 58 in the side wall 50. The lamp 16 herein includes an elongated bulb 60 having an effective length equal to or greater than the height of the printed area being irradiated which, in this instance, is about twelve inches. The bulb 60 is oriented vertically and supported at its upper and lower ends 62 and 64 respectively in a holder 66 which is mounted on the stationary housing 18 adjacent the opening 24. A reflector 68 is provided to direct radiation from the bulb 60 through the opening 58 to the interior of the housing 18. To prevent the bulb 60 from overheating during use, a blower 70 (FIG. 2) supported by the holder 66 maintains air flow about the bulb 60. The holder 66 is preferably mounted on hinges (not shown) to pivot to an open position to expose the curing station and facilitate changing of the bulb 60.

While a single, vertically-oriented bulb 60 is employed in the illustrated embodiment, other embodiments of the invention may include more than one bulb, or have a single bulb oriented horizontally. For example, two vertically oriented bulbs positioned end to end may be used for curing articles having greater height than the illustrated buckets, and a single horizontal bulb may be used for shorter articles. Also, two vertical bulbs positioned side by side may be preferable for articles of certain configurations.

The turntable 22 herein includes a generally circular plate 72 having a plurality of generally circular openings 74 formed in it at predetermined locations to accommodate the spin tables 32. The turntable 22 further includes a spider 76 which comprises a number of radially extending members 78 joined at a central hub 80 for supporting the spin tables 32 and the circular plate. The hub 80 is fixed to a rotatable shaft 82. The shaft 82 extends generally vertically downward from the center of the turntable 22 and is supported by upper and lower thrust bearings 84, 86 respectively mounted on horizontal support members 42.

The hub 80 herein includes upper and lower, horizontal extending plates 88 and 90 respectively disposed respectively above and below the radial members 78 and a stiffener means 92 which is fixed to the upper plate 88. The stiffener means 92 includes a generally cylindrical central member **93*a* and a plurality of generally triangular gusset plates 93*b* extending radially outward therefrom and welded thereto along their vertical edges and welded to the upper plate 88** along their lower horizontal edges.

As noted above, emission of ultraviolet radiation from the interior of the housing 18 is prevented by the upstanding divider means 26 which also divides the turntable into compartments. The divider means 26 herein includes a central wall 94 of generally circular cylindrical shape and a plurality of generally planar compartment walls 96 extending radially outward from the central wall 94. Both the central wall 94 and the compartment walls 96 are supported by the generally circular plate 72. The plate 72 is supported by an annular support 98 (FIG. 2) mounted on the spider 76.

In the illustrated embodiment, six spin tables 32 are evenly spaced about the turntable 22 and each spin table 32 is separated from the adjacent spin tables 32 on each side by one of the compartment walls 96. Each pair of adjacent compartment walls 96 thus defines an included angle of about 60°. This configuration provides that at least one radial compartment wall 96 is positioned between the lamp 16 and the opening 24 at all times during operation of the apparatus 10, while also providing adequate space for six relatively large articles 14 such as buckets to be carried simultaneously by the turntable 22.

It is preferred that the operator place articles on the spin tables 32 as the turntable 22 is moving, rather than continually stopping and starting the turntable 22 for loading and unloading. In the event that one of the articles 14 or the hand of a worker should jam the turntable 22 by becoming lodged between one of the radial walls 96 and the side wall 50 of the housing 18, it is desirable to limit the torque transmitted between the turntable 22 and the turntable drive means 28. To this end, the apparatus includes torque-limiting means 30 in the form of a slip-clutch. Also, a limit switch may be provided in the panel 27 to disconnect the motor drive for the turntable.

Referring particularly to FIGS. 6 and 7, the preferred turntable drive means 28 includes a driven pulley 102 fixedly mounted on the turntable shaft 82, and a drive pulley 104 connected to the driven pulley 102 by a drive belt 106 looped around the two pulleys 102 and 104. The length of the drive belt 106 is selected to provide slack in the belt. The drive pulley 104 is rotated by a variable speed motor 108 acting through a speed reducer 110. A slack adjuster for the belt 106 comprises a lever arm 112 pivotally supported at one end on a bolt 113 and having belt-engaging wheel 114 on its opposite end, and means 116 for biasing the lever arm 112 toward the belt 106 to urge the wheel 114 against the belt 106, thereby taking up slack in the belt 106.

During normal operation, the biasing force maintains enough tension on the belt 106 to prevent slippage between the belt 106 and the respective pulleys 102 and 104. When the turntable 22 encounters resistance above a predetermined level, slippage occurs between one or both of the pulleys 102 and 104 and the belt 106, which enables the motor 108 to continue turning while the turntable 22 is stopped. Thus, a slip clutch action limits the torque to prevent a hand from being seriously injured.

As best seen in FIGS. 2 and 3, each of the spin tables 32 herein is generally circular and is supported by one of the radial members 78 of the spider 76. Each spin table 32 is mounted on a shaft 118 extending vertically downward from its center, and each of the shafts 118 is supported in a thrust bearing 120 mounted on the associated support member 78.

As noted above, spin table drive means 34 and an associated clutch assembly 36 are provided to rotate each spin table 32 as it passes the ultraviolet lamp 16. The clutch assembly 36 herein includes a continuously rotating drive wheel 122 for cooperation individually with a plurality of driven wheels 124, one mounted on each of the spin table shafts 118. Each driven wheel 124 is adapted to be rotated by engagement between its peripheral surface 126 and the peripheral surface 128 of the drive wheel 122.

Suitable material is disposed on the respective peripheral surfaces 126 and 128 to provide adequate frictional engagement therebetween. The drive wheel 122 is mounted on a clutch lever 130 which is pivotally supported on one of the frame members 42.

The power for the spin table drive 34 herein is provided by a variable speed electric motor 132 acting through an associated gearbox 134, both of which are mounted on the clutch lever 130. To avoid damaging the gearbox 134 with shock loads as the drive wheel 122 comes to engagement with a driven wheel 124, a belt drive 136 (FIG. 5) connects the output shaft 138 of the gearbox 134 to the drive wheel shaft 140. The belt drive comprises a first pulley 142 mounted on the output shaft 138, a second pulley 144 mounted on the drive wheel shaft 140, and a V-belt 146 interconnecting the pulleys.

Referring particularly to FIG. 4, the clutch lever 130 and drive wheel 122 herein are positioned as illustrated in broken lines prior to engagement with one of the driven wheels 124. As the turntable 22 rotates, one of the driven wheels 124 comes into engagement with the drive wheel 122. The drive wheel 122 rotates continuously during operation of the apparatus 10, so that the spin table 32 begins to rotate when the driven wheel 124 moves into engagement with the drive wheel 122.

To enable contact to be maintained between the drive wheel 122 and the particular driven wheel 124 as the spin table 32 travels past the light source 16, the clutch lever 130 pivots about a vertical axis 148 (FIGS. 4 and 5) through a mounting block 150 mounted on the frame member 42. At a predetermined location past the ultraviolet lamp 16, the driven wheel 124 moves out of engagement with the drive wheel 122. The clutch lever 130 is then returned to its initial position by biasing means such as the illustrated coil spring 152 (FIG. 4). To control the speed at which the clutch lever 130 is pivoted by the spring 152, damping means such as the illustrated shock absorber 154 are provided. The shock absorber 154 herein is pivotally connected to the frame member 42 at one end and to the clutch lever 130 at the other end. Once the clutch lever 130 has returned to its initial position, the drive wheel 122 is in position to engage the next driven wheel 124 approaching the ultraviolet lamp 16.

Operation of an ultraviolet lamp in normal atmosphere produces ozone. To prevent ozone from accumulating in the work area around the apparatus 10, exhaust means 156 are provided for removing ozone from the interior of the housing 18 at the curing station adjacent the ultraviolet lamp 16. The exhaust means 56 may be connected to a suitable duct (not shown) having an outlet at a location remote from the work area.

If an article 14 is not located approximately centrally upon a spin table 32, rotation of the spin table 32 may cause the article 14 to tip over or slide off of the spin table 32. Accordingly, it is desirable that the operator center each article 14 upon its associated spin table 32. Locating devices such as pins (not shown) may be provided on the spin tables to center the article and to hold the same against movement during the spinning and curing.

It will be appreciated that under normal working conditions, it may be desirable for a worker to stop the turntable 22 momentarily to adjust the position of an article 14 upon its spin table 32 or for some other reason. However, stopping the turntable 22 may result in overexposure of an article to the ultraviolet lamp 16 which may cause overheating. It is undesirable to turn the lamp on and off repeatedly because this might reduce bulb life, and because there may be a warm-up time required to bring the bulb to full light-emitting capacity after it is turned off. Accordingly, to enable the turntable 22 to be stopped without overheating an article 14 adjacent the lamp 16, the apparatus 10 includes control means 158 for putting the apparatus 10 into a standby mode wherein the turntable 22 stops rotating, the power to the ultraviolet lamp 16 is reduced, and the spin table 32 adjacent the ultraviolet lamp 16 continues to rotate. In one embodiment, the lamp emits 300 watts per square in. during normal operation, and emits 125 watts per square in. in standby mode. In the illustrated embodiment, the control means 158 is connected to a foot switch 160 for putting the apparatus 10 into standby mode. Depression of the foot switch 160 initiates standby mode, and release of the foot switch 160 returns the apparatus 10 to normal condition. Additional switches and the like are mounted upon a control panel 162 attached to the housing 18.

Turning now to a description of the method of the present invention, the first step of the method comprises inserting an article 14 through the opening 24 in the housing 18 and placing it upon a spin table 32 as the turntable 22 rotates. It will be appreciated that during normal operation, the articles 14 will be successively placed one by one onto the respective spin tables 32 in the respective compartments, either manually or mechanically. Also, two operators may be used with one operator placing articles on the spin tables for travel to the curing station and with another operator removing cured articles from a spin table having recently passed through the curing station.

The turntable 22 preferably rotates continuously to transport the articles 14 successively past the ultraviolet lamp 16. However, as noted above, it may be necessary to stop the rotation of the turntable 22 momentarily by switching the apparatus 10 to standby mode for adjustment of the position of an article 14 or for some other reason.

As each spin table 32 approaches the ultraviolet lamp 16, the spin table drive 34, acting through the clutch assembly 36, commences rotation of the spin table 32. It is desirable that each spin table 32 rotate through more than 360° so that each article 14 is exposed to the ultraviolet lamp 16 on all sides as the turntable carries the article in one direction about the turntable axis while the article spins about the axis generally through its vertical centerline.

In addition to irradiating the articles with ultraviolet light, the ultraviolet lamp 16 also heats the articles. Continuous exposure of a particular portion of an article 14 to the ultraviolet radiation may overheat that portion of the article 14 and damage it. To avoid such overheating while providing adequate time of exposure to the ultraviolet radiation, it may be desirable to rotate each article 14 through two or three complete revolutions as it passes the ultraviolet lamp 16. This enables every part of the article 14 to be exposed for two or three separate, relatively short time periods rather than one relatively long time period, enabling cooling to take place between exposures. Also, by providing two or three complete revolutions, a large margin of error is provided to insure that each article 14 actually rotates through at least 360° while it is being transport through a 60° sector of the turntable travel.

To facilitate removal of the articles 14 from their associated spin tables 32, as each spin table 32 reaches a predetermined location beyond the ultaviolet lamp 16, the clutch assembly 36 disengages to permit the rotation of the spin table 32 to slow or stop. As each spin table compartment reaches a position accessible through the opening 24 in the housing 18, the article 14 is removed manually or mechanically through the opening 24, leaving the spin table compartment available for the next article 14 to be placed therein.

From the foregoing, it will be appreciated that the present invention provide a novel and improved method and apparatus for curing ink on exterior surfaces of articles. While a preferred embodiment has been illustrated and described, there is no intent to limit the scope of the invention to this or any other particular embodiment. The scope of the invention is defined by the spirit and language of the following claims.

What is claimed is:

1. Apparatus for curing ink on exterior surfaces of articles by irradiating the exterior surfaces of the articles, the apparatus comprising:

a frame;

a housing supported by the frame and having at least one opening to enable articles to be inserted or withdrawn from the interior of the housing;

irradiating means for irradiating the exterior surfaces of articles while they are within the housing at a curing station;

a horizontally disposed turntable supported by the frame and mounted for rotation about a vertical axis within the housing for carrying articles in a circular path from the opening through the curing station and to a discharge station;

drive means for rotating the turntable, means including a plurality of upstanding walls on the turntable dividing the turntable into a plurality of article-receiving compartments; and horizontally disposed spin tables mounted on said turntable to spin about vertical axes in each compartment and for spinning the articles at the curing station.

2. Apparatus in accordance with claim 1 wherein the drive means include torque limiting means to prevent torque on the turntable from exceeding a predetermined maximum.

3. Apparatus for curing ink on exterior surfaces of articles by irradiating the exterior surfaces of the articles, the apparatus comprising:

a frame;

a housing supported by the frame and having at least one opening to enable articles to be inserted or withdrawn from the interior of the housing;

irradiating means for irradiating the exterior surfaces of articles while they are within the housing at a curing station;

a turntable supported by the frame and mounted for rotation within the housing for carrying articles in a circular path from the opening through the curing station;

drive means for rotating the turntable, means dividing the turntable into a plurality of article-receiving compartments; and means for spinning the articles at the curing station as they are being transported past the irradiating means by the turntable within their respective compartments, the drive means comprising an electric motor and a belt drive connecting the motor to the turntable, and the torque limiting means comprising a slip clutch.

4. Apparatus for curing ink on exterior surfaces of articles by irradiating the ink, the apparatus comprising:

a frame;

a housing fixed to the frame;

a radiation source fixedly supported by said frame;

a turntable rotatably supported by the frame;
turntable drive means for rotating the turntable;
a plurality of spin tables rotatably mounted upon the turntable for supporting said articles from below; and
spin table drive means for rotating said spin tables so that articles supported by said spin tables may be irradiated on all sides by the radiation source,
said turntable drive means including a motor, a rotating drive shaft driven by the motor, a drive pulley fixed to the drive shaft, a turntable shaft fixed to the turntable and extending through its center of rotation, a driven pulley fixed to the turntable shaft, a drive belt looped around the respective pulleys, and belt tension control means for preventing tension on the belt from exceeding a predetermined maximum.

5. Apparatus in accordance with claim 4 wherein said belt tension control means comprises a pivotal arm having belt engaging means on its free end, and biasing means for urging the belt engaging means against the drive belt to take up slack in the drive belt.

6. Apparatus for curing ink on exterior surfaces of articles by irradiating the ink, the apparatus comprising:
a frame;
a housing fixed to the frame;
a radiation source fixedly supported by said frame;
a turntable rotatably supported by the frame;
turntable drive means for rotating the turntable;
a plurality of spin tables rotatably mounted upon the turntable for supporting said articles from below;
spin table drive means for rotating said spin tables so that articles supported by said spin tables may be irradiated on all sides by the radiation source,
control means for enabling rotation of the turntable to be stopped and power to the ultraviolet lamp to be reduced to a predetermined level while maintaining rotation of the spin tables.

7. Apparatus for curing ink on exterior surfaces of articles by irradiating the exterior surfaces of the articles with ultraviolet radiation, the apparatus comprising:
a frame;
a housing fixed to the frame;
an ultaviolet lamp for providing ultraviolet radiation at a curing station within the housing;
a turntable rotatably supported by the frame;
turntable drive means for continuously rotating the turntable;
a plurality of spin tables rotatably mounted upon the turntable for supporting said articles from below;
spin table drive means for selectively rotating the spin tables at the curing station,
spin table drive means including a clutch means comprising a plurality of spin table shafts, one depending from each spin table, a plurality of driven wheels, one fixedly mounted on each spin table shaft, and a drive wheel rotated by the spin table drive means for engaging each of the driven wheels, one at a time, as their associated spin tables approach the ultraviolet lamp.

8. Apparatus in accordance with claim 7 wherein each of the driven wheels has a peripheral friction surface adapted for frictional engagement with the peripheral surface of the drive wheel.

9. Apparatus in accordance with claim 7 wherein the drive wheel is mounted on a pivotal arm so that the drive wheel may remain in engagement with one of the driven wheels for a predetermined period of time as the turntable rotates.

10. A method for curing ink on exterior surfaces of articles by exposing the articles to a radiation source at a curing station within a housing, the method comprising the steps of:
inserting the articles one by one through an opening in the housing and placing each article on a horizontally disposed spin table rotatably supported upon a horizontally disposed turntable within the housing either manually or mechanically;
rotating the turntable to bring each of series of compartments on the table to transport the articles in a circular path successively past the radiation source within the housing;
selectively rotating each spin table about a vertical axis as it passes through the curing station and past the radiation source while the turntable continues to rotate; and
removing the articles one by one from their associated spin tables as the turntable continues to rotate.

11. A method in accordance with claim 10 wherein the step of rotating each spin table as it passes through the curing station comprises rotating the spin table through at least 360°.

12. A method for curing ink on exterior surfaces or large pails by exposing the pails to a radiation source at a curing station within a housing, the method comprising the steps of:
inserting the pails one by one through an opening in the housing and placing each pail on a horizontally disposed spin table rotatably supported in a compartment in a horizontally disposed turntable within the housing so that the vertical axis of each pail is substantially aligned with the vertical axis of rotation of its associated spin table;
rotating the turntable to transport the pails and each of the compartments successively past the radiation source within the housing;
selectively rotating each spin table at the curing station and past the radiation source to irridate the article while the turntable continues to rotate; and
removing the pails one by one from their associated spin tables through the opening as each of the compartments and its respective spin table arrives at a location adjacent the opening.

13. Apparatus for curing ink on exterior surfaces of articles by irradiating the exterior surfaces of the articles with ultraviolet radiation, the apparatus comprising:
a frame;
a housing fixed to the frame and have a loading station opening and an unloading station opening;
an ultraviolet lamp for providing ultraviolet radiation at a curing station within the housing;
a horizontally disposed turntable rotatably supported by the frame for turning about a vertical axis;
turntable drive means for rotating the turntable;
a plurality of horizontally disposed spin tables rotatably mounted upon the turntable for spinning about a vertical axis and supporting said articles from below; means dividing the turntable into a plurality of compartments each having a spin table movable from a loading station through the curing station and through the unloading station in a circular travel path, and
spin table drive means for selectively rotating the spin tables at the curing station.

14. A method for curing ink on exterior surfaces of articles by exposing the articles to a radiation source at a curing station within a housing, the method comprising the steps of:

inserting the articles one by one through an opening in the housing and placing each article on a spin table rotatably supported upon a turntable within the housing either manually or mechanically;

continuously rotating the turntable to transport the articles successively past the radiation source within the housing;

selectively rotating each spin table as it passes through the curing station and past the radiation source while the turntable continues to rotate; and removing the articles one by one from their associated spin tables as the turntable continues to rotate either manually or mechanically, the step of rotating each spin table comprising the steps of:

commencing engagement between a driven wheel connected to the spin table and a continuously spinning drive wheel as the spin table approaches the curing station;

maintaining engagement between the drive wheel and the driven wheel as the spin table passes through the curing station; and discontinuing engagement between the drive wheel and the driven wheel at a predetermined location after the spin table has passed the curing station to enable the rotation of the spin table to slow or stop.

15. Apparatus for curing ink on exterior surfaces of articles by irradiating the ink, the apparatus comprising:

a frame;

a housing fixed to the frame;

a radiation source fixedly supported by said frame;

a horizontally disposed turntable rotatably supported by the frame for turning about a vertical axis; means dividing the turntable into a plurality of compartments;

turntable drive means for rotating the turntable;

a plurality of horizontally disposed spin tables rotatably mounted upon the turntable for turning about a vertical axis and for supporting said articles from below; a spin table being mounted in each compartment, and spin table drive means for rotating said spin tables so that articles supported by said spin tables may be irradiated on all sides by the radiation source.

* * * * *